US006802788B1

(12) United States Patent
Moushi et al.

(10) Patent No.: US 6,802,788 B1
(45) Date of Patent: Oct. 12, 2004

(54) TETHER SYSTEM FOR A BALL

(75) Inventors: Issac George Moushi, Wilmette, IL (US); Michael H. Braverman, Chicago, IL (US); Robert H. Rosenfeld, Glencoe, IL (US)

(73) Assignee: Zak's Sports Products, LLC, Northbrook, IL (US)

( * ) Notice: Subject to any disclaimer, the term of this patent is extended or adjusted under 35 U.S.C. 154(b) by 0 days.

(21) Appl. No.: 10/603,840

(22) Filed: Jun. 25, 2003

(51) Int. Cl.[7] ..... A63B 69/00
(52) U.S. Cl. ..... 473/426; 473/430
(58) Field of Search ..... 473/426, 423, 473/424, 425, 427, 428, 429, 430; D21/466; 95/905

(56) References Cited

U.S. PATENT DOCUMENTS 3,227,450 A * 1/1966 Pruitt ..... 473/426
4,042,241 A * 8/1977 Collins ..... 473/424
4,095,787 A * 6/1978 Saferstein ..... 473/423
4,350,338 A * 9/1982 May ..... 473/423
4,614,339 A * 9/1986 Schanwald ..... 473/451
4,720,095 A * 1/1988 Sowards ..... 473/423
5,280,922 A * 1/1994 Jones ..... 473/426
5,542,661 A * 8/1996 Gregan ..... 473/423
5,620,186 A * 4/1997 Dudley ..... 473/423
5,692,975 A * 12/1997 Hesse ..... 473/426
5,772,542 A * 6/1998 Gildea et al. ..... 473/576
6,152,838 A * 11/2000 Killion ..... 473/424
6,352,484 B1 * 3/2002 Killion ..... 473/424

* cited by examiner

*Primary Examiner*—Gregory Vidovich
*Assistant Examiner*—M. Chambers
(74) *Attorney, Agent, or Firm*—Katten Muchin Zavis Rosenman; John S. Paniaguas

(57) ABSTRACT

A tether system for a ball, such as a soccer ball, includes a simple swivel that is adapted to be connected directly to an extending tab on a ball. The swivel fastener is a two piece member. The two piece swivel is relatively less expensive than other more complicated swivel connectors, thus reducing the overall cost of the tether system. In addition, since the two piece swivel can be connected directly to on the ball, the tether system in accordance with the present invention also eliminates a process step of connecting the swivel to an intermediate ring, thus further reducing the cost of the tether system.

5 Claims, 3 Drawing Sheets

TETHER SYSTEM FOR A BALL

BACKGROUND OF THE INVENTION

1. Field of the Invention

The present invention relates to a tether system for a ball and more particularly to a tether system for a ball, such as a soccer ball, the tether system being adapted to be fastened to oppositely extending tabs on the ball and including a simplified swivel fastener configured to be attached directly to the extending tabs in order to simplify the manufacturing process.

2. Description of the Prior Art

Various practice balls are known in the art. For example, U.S. Pat. No. 4,614,339 discloses a practice baseball which has a smaller diameter than a regulation baseball but has the same density as a regulation baseball so that it has the same feel as a regulation baseball. Other practice systems are also known and include tethered ball arrangements. For example, U.S. Pat. No. 3,227,450 discloses a practice football system which includes an outer jacket that is adapted to be attached to a regulation football. A pair of elastic cords are attached to the outer jacket and attached. at extending ends to stakes, which, in turn, are adapted to be pounded into the ground. U.S. Pat. No. 5,280,922; 5,620,186; 6,152,838; 6,352,484; 5,692,975 all disclose practice systems for soccer balls. More particularly, U.S. Pat. No. 5,280,922 discloses a training platform which includes a pair of space to part L-shaped members. The L-shaped members are configured such that a short leg of each member faces upwardly. Elastic cords are attached adjacent the ends of the upwardly facing L-shaped members. The other ends of the elastic cords are attached to a soccer ball. The platform is configured to hold the soccer ball at ground level to provide practice in kicking such soccer balls. Unfortunately, the system disclosed in the '922 patent does not provide a good feel to the practice kicker since the elastic cords are relatively short.

In order to solve this problem tether systems have been developed in which the balls are attached to a tether that is anchored. For example, U.S. Pat. Nos. 3,227,450; 5,620,186; 6,152,838 and 6,352,484 relate to tether systems which include a cover that is configured to be placed over a ball. A tether is attached to the cover at one end. The other end of the tether is adapted to be anchored. U.S. Pat. No. 3,227,450 discloses a tether system which includes a cover that is.adapted to placed over a regulation football. The cover is adapted to be slipped over the football and must provide a relatively tight fit relative thereto and is thus rather cumbersome to use. As such, tether systems have been developed which include covers formed from criss-cross straps, attachable by way of a fastener system, such as Velcro. For example, U.S. Pat. No. 5,620,186 includes a pair of criss-cross straps which include a fastening system, such as Velcro, that is adapted to be placed on the outside of the ball. U.S. Pat. No. 6,152,838 and 6,352,484 similarly discloses criss-cross straps that are adapted to be attached to the ball by way of Velcro fasteners. Unfortunately, such systems have been known to come apart during practice, thus becoming burdensome to use. As such other systems have been developed in which the tether system is attached directly to extending tabs formed in the ball. For example, U.S. Pat. No. 5,772,542 discloses a tether system for a football in which an extending tab with a through hole is formed on one tip of the football. An elastic cord is attached to the extending tab by way of a swivel fastener. The swivel fastener prevents the cord from getting wound up. Unfortunately, the swivel fasteners disclosed in U.S. Pat. No. 5,772,542 require the use of a separate ring to be attached between the through hole and the extending tab. In particular, the swivel disclosed in the '542 patent is formed from five pieces and includes a pair of rings at each end. The swivel connector disclosed in the '542 patent is relatively expensive and requires the use of additional rings to connect to the through holes in the extending tabs attached to the ball. As such, the tether system disclosed in the '542 patent is more expensive because of the additional rings and the additional process step in connecting an additional connecting ring between the swivel and the through hole in the extending tab. Thus, there is a need for a relative less complicated and thus less expensive tether system for a ball.

SUMMARY OF THE INVENTION

Briefly, the present invention relates to a tether system for a ball, such as a soccer ball, which includes a simple swivel that is adapted to be connected directly to an extending tab on a ball. The swivel fastener is a two piece member. The two piece swivel is relatively less expensive than other more complicated swivel connectors, thus reducing the overall cost of the tether system. In addition, since the two piece swivel can be connected directly to on the ball, the tether system in accordance with the present invention also eliminates a process step of connecting the swivel to an intermediate ring, thus further reducing the cost of the tether system.

DESCRIPTION OF THE DRAWINGS

These and other advantages of the present invention will be readily understood with reference to the following specification and attached drawing wherein.

DETAILED DESCRIPTION

The present invention relates to a tether system for a ball, for example, a soccer ball, that includes a two piece swivel fastener that is less expensive to manufacture and also eliminates a process step. More particularly, as will be described in below, the swivel fastener that forms part of the present invention is adapted to be connected directly to the soccer ball, thus eliminating a process step of attaching a ring between the soccer ball and the swivel fastener. Thus, the tether system in accordance with the present invention further reduces the cost of the tether system relative to known systems.

Figure 1:
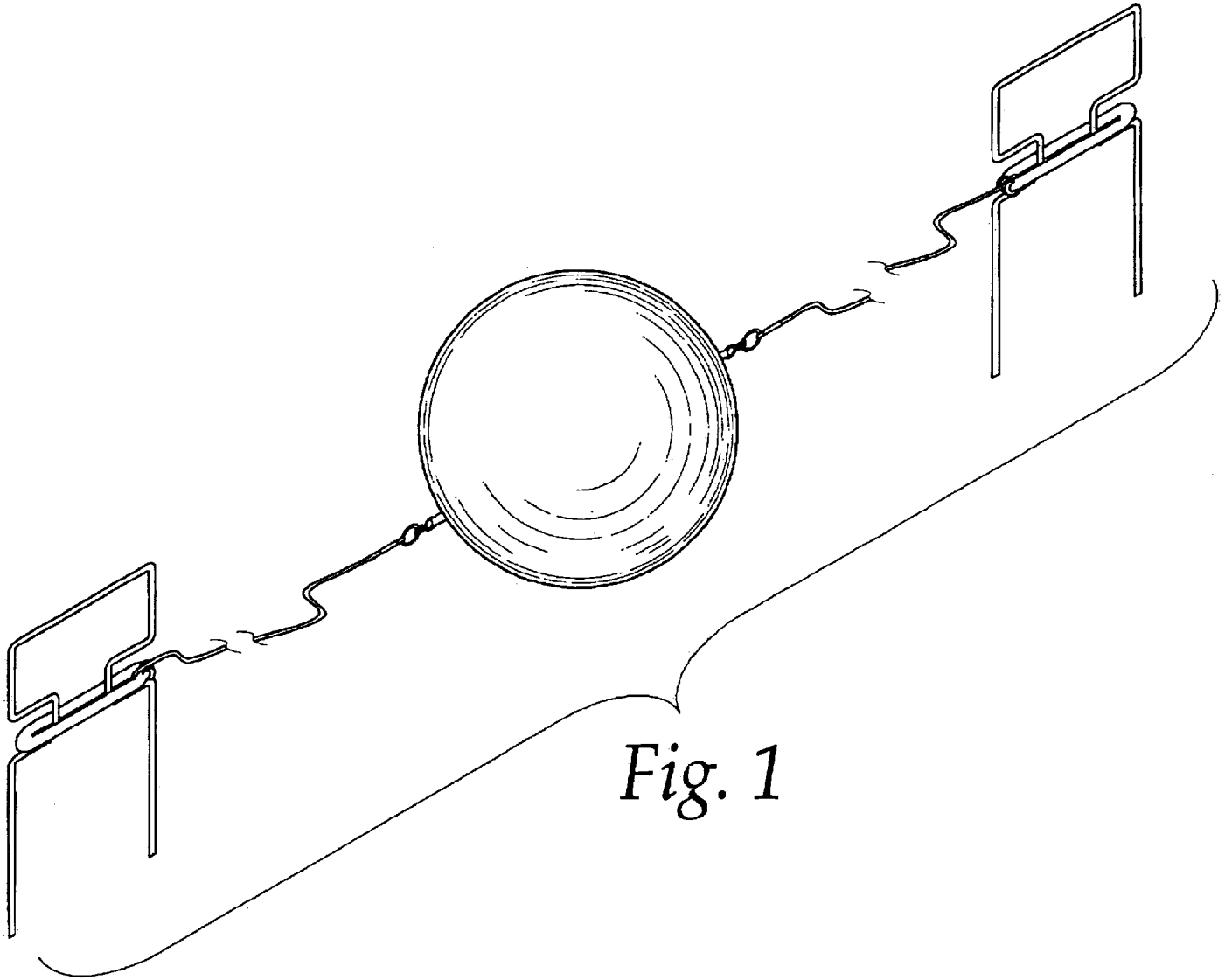
FIG. 1 is a perspective view of the tether system in accordance with the present invention illustrating the tether system connected to a soccer ball.
Figure 2:
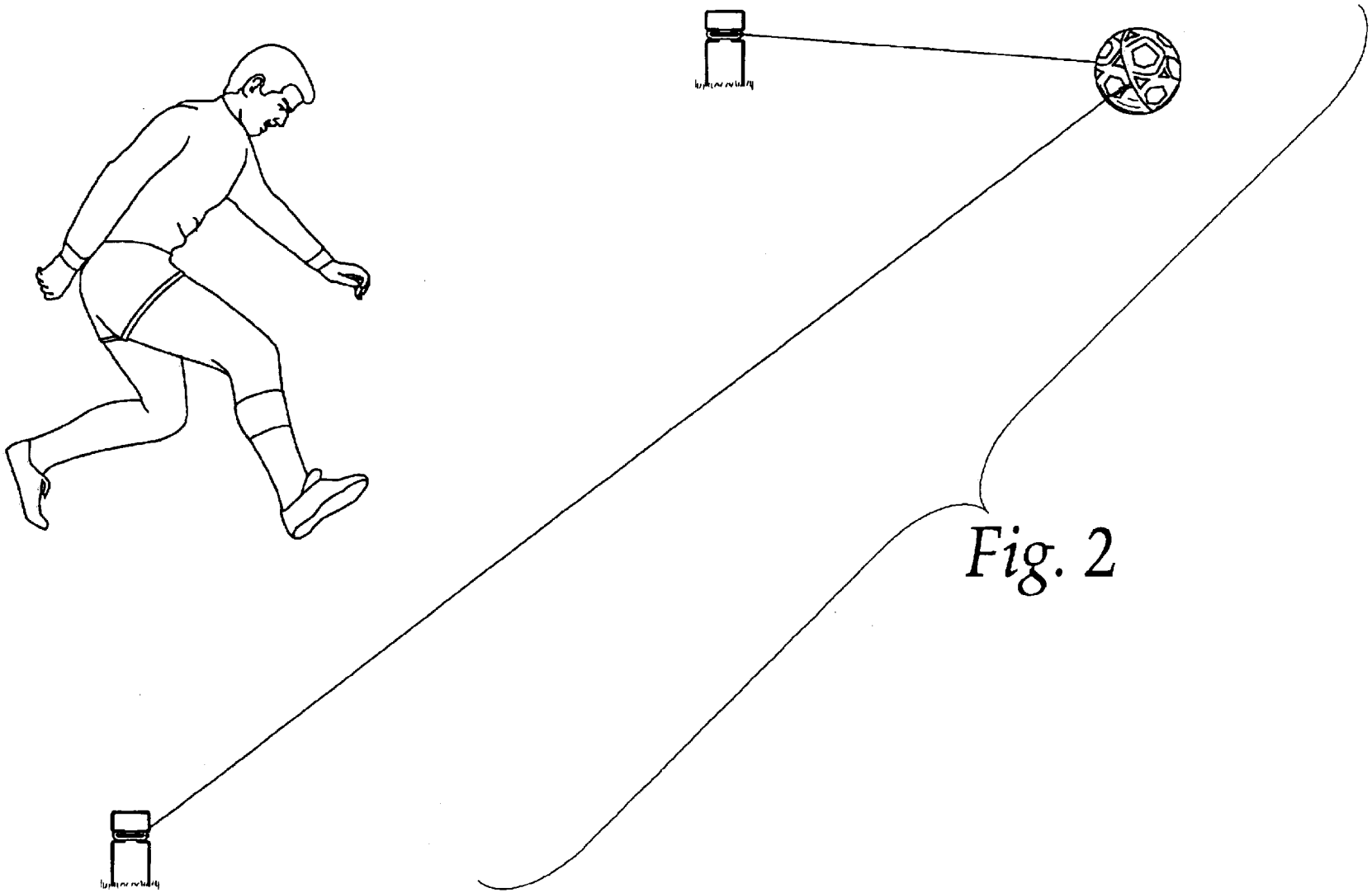
FIG. 2 is similar to FIG. 1 illustrating the extension of the elastic cords after the soccer ball has been kicked.

The tether system in accordance with the present invention is generally illustrated in FIGS. 1 and 2 and is generally identified with the reference numeral 20. FIG. 1 illustrates the tether system in a static position, while FIG. 2 illustrates the position of the tether system 20 in a dynamic position after being kicked.

Although the system is described in the illustration in terms of a soccer ball, the principles of the present invention may be used with other practice balls. For example, the system may be used with volleyballs, footballs and the like.

Referring back to FIGS. 1 and 2, the tether system 20 includes a practice ball 22, for example, a soccer ball. The soccer ball 22 is provided with a pair of extending tabs 24 and 26 for connection to the tether system. In accordance with an important aspect of the invention, two-piece swivel connectors 28, 30 are adapted to the attached directly to the extending tabs 24 and 26. Elastic cords 32 and 34 are provided and are also connected directly to the swivel fasteners 28 and 30, respectively. Extending ends of the elastic cords 32 and 34 may be attached to a pair of elastic rings 36 and 38. These elastic rings 36 and 38 facilitate attachment of the elastic cords 32, 34 to a pair of oppositely disposed stakes 40 and 42, In operation, in a static position, for example, as shown in FIG. 1, static tension in the elastic cords 32 and 34 may be either zero or minimal. Once the soccer ball 22 is kicked, the elastic cords 32 and 34 elongate as shown in FIG. 2 increasing the tension in elastic cords 32 and 34 linearly as a function of the spring constant of the elastic cords.

In accordance with an important aspect of the invention, the swivel fasteners 28, 30 are configured to be attached directly to the extending tabs 24, 26 on the soccer ball 22. As shown best in FIGS. 3 and 4, the extending tabs 24 and 26 may be formed by a folded strip of material in which both extending ends are firmly attached to the soccer ball 22 forming a loop. Alternatively, the extending tabs 24, 26 can be formed from a solid strip of material with a through-hole, for example, as illustrated in U.S. Pat. No. 5,772,542.

Figure 3:
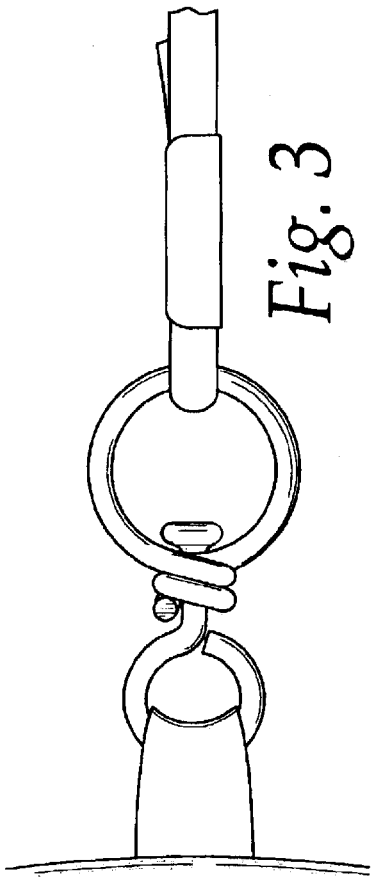
FIG. 3 is a partial view of the tether system in accordance with the present invention illustrating the two piece swivel fastener shown in an assembled position.
Figure 4:
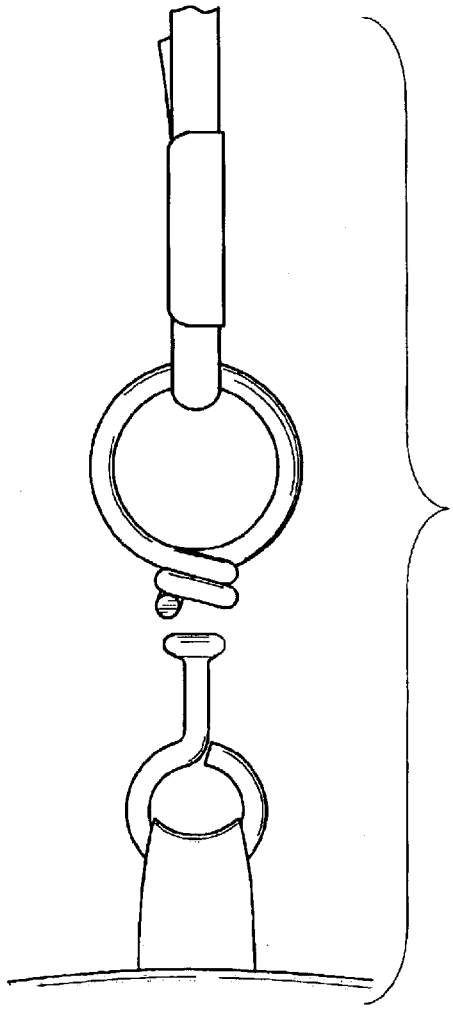
FIG. 4 is similar to FIG. 3 but illustrating the two piece swivel fastener in an unassembled position.

In accordance with an important aspect of the invention, the swivel fasteners 28, 30 are formed as two-piece members, as best shown in FIGS. 3 and 4. More particularly, the swivel fasteners 28, 30 include a first member 44 and a cooperating second member 46. The first member 44 is formed from a rod-like material formed as a closed loop portion 47 on one end and with an increased diameter portion 48 on an extending end. The second member 46 is formed with a loop or ring portion 49 on one end and a spiral portion 50 on an opposing end. The closed loop portion 47 may be formed in any diameter to accommodate connections to virtually any type of extending tab from a ball. As such, the swivel fasteners 28, 30 may be connected directly to the extending tabs 24, 26, thereby eliminating the need for an additional ring and eliminating the process step of attaching the additional ring to the extending tab and the swivel fasteners. The other member 46 includes the spiral portion 50 that is adapted to be received in a neck portion 52 of the first member 44 between the loop portion 47 and the increased diameter portion 48 to form a swivel connection.

The loop portion 49 of the second member 46 may also be used for direct connection of the elastic cords 32, 34 as shown in FIGS. 3 and 4. In particular, the elastic cords 32, 34 are simply looped through the ring portion 49. A barrel connector 54 may then be crimped over the folded over portions of the elastic cords 32, 34.to secure the elastic cords 32, 34 to the ring portion 49 of the member 46. Thus, unlike the configuration disclosed in U.S. Pat. No. 5,772,542, the swivel fastener 28, 30 in accordance with the present invention simplifies the manufacturing process of connecting the swivel fasteners 28, 30 in the tether system 20 as well as provides a reduced cost swivel connector.

Figure 5:
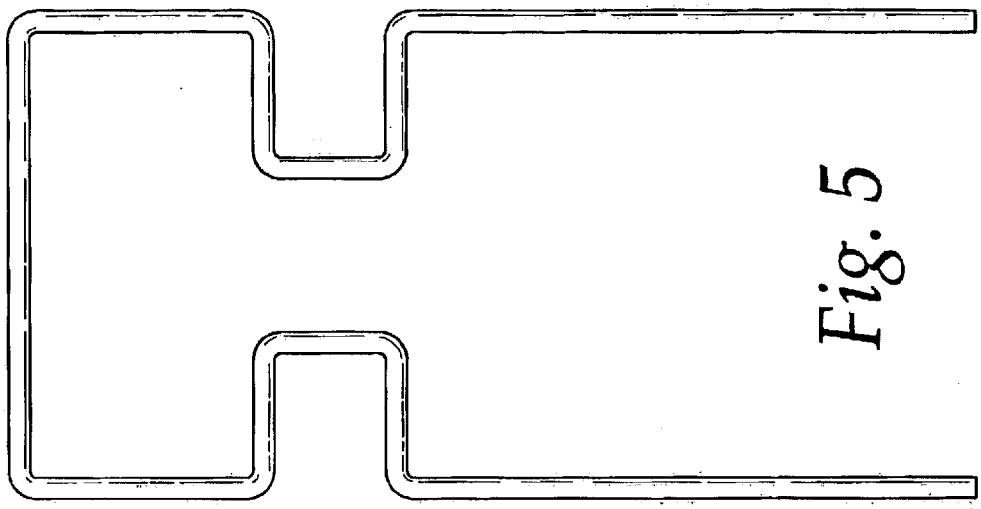
FIG. 5 is a view of a stake for use with the present invention.
Figure 6:
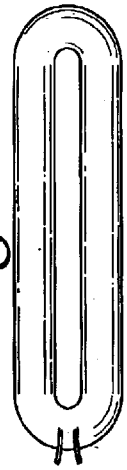
FIG. 6 is a view of an elastic ring that is connected to an elastic cord on one end and slipped over the stake illustrated in FIG. 5 on the other end.

FIG. 5 illustrates exemplary stakes 40, 42 that may be used with the tether system 20 in accordance with the present invention. These stakes 40, 42 may be formed from relatively stiff wire in a generally U shape as shown and include indented cord retention portions 56 and 58. An elastic ring 38, 39 (FIG. 6) may be connected to the opposing ends of the elastic cords 32, 34 by the method disclosed above. The elastic ring 38, 39 may be simply stretched over a head portion 62 of the stakes 40 and 42 and received in the cord retention portions 56 and 58 as generally shown in FIG. 1. When not in use the elastic cords 32, 34 may simply be wrapped in the cord retention portions 56 and 58.

Obviously, many modifications and variations of the present invention are possible in light of the above teachings. Thus, it is to be understood that, within the scope of the appended claims, the invention may be practiced otherwise than as specifically described above.

What is claimed and desired to be covered by a Letters Patent is as follows:

1. A tether system comprising:

a practice ball having one or more extending tabs;

one or more swivel connectors formed from two pieces and configured to be directly attached to such one or more extending tabs; and one or more elastic cords connected to said one or more swivel connectors, wherein said swivel connectors include a first member and a second member, said first member formed with a first loop portion and an enlarged diameter portion and a neck portion, therebetween, said second member formed with a second loop portion and a helical portion, said helical portion adapted to receive said neck portion.

2. The tether system as recited in claim 1, wherein said extending tabs include a folded portion of material forming a loop for receiving said first loop portion of said swivel connector.

3. The tether system as recited in claim 1, further including one or more stakes for attachment to an extending end of said elastic cords.

4. The tether system are recited in claim 3, wherein said stakes are formed in a generally U-shape with cord retaining portions and are configured with a head portion.

5. The tether system as recited in claim 4, further including an elastic ring for attaching to one end of said elastic cord and configured to be stretched over said head portion of said stakes and received in said cord retaining portions of said stakes.

* * * * *